United States Patent [19]

Horodysky

[11] Patent Number: 4,492,642

[45] Date of Patent: Jan. 8, 1985

[54] AMMONIATED BORATED EPOXIDES AND LUBRICANTS AND FUELS CONTAINING SAME

[75] Inventor: Andrew G. Horodysky, Cherry Hill, N.J.

[73] Assignee: Mobil Oil Corporation, New York, N.Y.

[21] Appl. No.: 504,116

[22] Filed: Jun. 14, 1983

[51] Int. Cl.[3] ..... C10M 1/36; C10M 1/54

[52] U.S. Cl. ..... 252/49.6; 252/50; 252/51.5A; 564/297; 564/298; 260/462 R; 260/462 C

[58] Field of Search ..... 252/49.6, 51.5 A, 50; 564/297, 298; 260/462 R

[56] References Cited

U.S. PATENT DOCUMENTS

| | | | |
|---|---|---|---|
| 3,316,287 | 4/1967 | Nunn et al. | 252/49.6 |
| 3,373,111 | 3/1968 | Le Suer et al. | 252/51.5 A |
| 3,711,411 | 1/1973 | Sawyer et al. | 252/49.6 |
| 4,382,006 | 5/1983 | Horodysky | 252/49.6 |
| 4,410,438 | 10/1983 | Horodysky | 252/49.6 |

*Primary Examiner*—Jacqueline V. Howard

*Attorney, Agent, or Firm*—Alexander J. McKillop; Michael G. Gilman; Claude E. Setliff

[57] ABSTRACT

Lubricant and liquid fuel compositions containing a product made by reacting a borating agent with an ammoninated hydrocarbyl epoxide are provided. The invention also provides the product per se and a method of reducing fuel consumption in an internal combustion engine using fuel and lubricant compositions containing same.

25 Claims, No Drawings

AMMONIATED BORATED EPOXIDES AND LUBRICANTS AND FUELS CONTAINING SAME

BACKGROUND OF THE INVENTION

1. Field of the Invention:

The invention is concerned with a novel group of compounds and their use in lubricants or liquid fuels as friction reducers, antioxidants or antiwear corrosivity reducers (e.g., copper corrosion reducers).

2. Discussion of the Prior Art:

It is known that sliding or rubbing metal or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present herein.

Friction is also a problem any time two surfaces are in sliding or rubbing contact. It is of especial significance in an internal combustion engine and related power train components, because loss of a substantial amount of the theoretical mileage possible from a gallon of fuel is traceable directly to friction.

With respect to the novel compounds of this invention, no art is known that teaches or suggests them. However, certain forms of epoxides have been used in lubricants. For example, U.S. Pat. No. 4,244,829 describes the use of epoxidized fatty acid esters as lubricity agents in lubricating oils.

SUMMARY OF THE INVENTION

In accordance with the invention, there is provided a lubricant composition containing a compound prepared by (1) reacting an epoxide of the formula

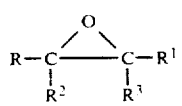

wherein R, $R^1$, $R^2$ and $R^3$ are hydrogen or $C_8$-$C_{30}$ hydrocarbyl groups, at least one of which is a hydrocarbyl group, a nitrogen compound of the formula $$(R^4)_aNX$$

wherein $R^4$ is hydrogen or a $C_1$ to $C_3$ hydrocarbyl group, X is hydrogen or hydroxyl, a being 2 when X is hydrogen or 4 when X is hydroxyl and (2) reacting the material thus formed with a boron compound, such as boric acid, boric oxide or an alkyl borate of the formula $$(RO)_xB(OH)_y$$

wherein x is 1 to 3 and y is 0 to 2, their sum being 3, and $R^5$ is an alkyl group containing from 1 to 6 carbon atoms.

The invention also provides a lubricant or liquid fuel composition comprising a lubricant or fuel and a friction reducing amount of the product. It is further contemplated that the product will aid in the reduction of fuel consumption in an internal combustion engine when the engine is fueled with said fuel composition or lubricated with said lubricant composition or when both compositions are used concurrently.

DESCRIPTION OF SPECIFIC EMBODIMENTS

As has been mentioned hereinabove, the compounds of this invention can be made by reacting an epoxide with ammonia or an ammonium compound followed by reaction with, for example, boric acid or an alkyl borate. The products obtained are primarily ammoniated borate esters. Among possible other products present are the products of reaction between ammoniated epoxide dimers, or higher oligomers, with a boron compound to form the corresponding borate esters.

Included within the scope of the epoxides as set forth above, are 1,2-epoxydecane, 1,2-epoxydodecane, 1,2-epoxytetradecane, 1,2-epoxypentadecane, 1,2-epoxyhexadecane, 1,2-epoxyheptadecane, 1,2-epoxyoctadecane, 1,2-epoxyeicosane and mixtures of such epoxides. Hydrocarbyl is meant to include alkyl, alkenyl, aryl, aralkyl, alkaryl, cycloalkyl or cycolalkenyl groups containing from 8 to 30 carbon atoms, preferably 10 to 22 carbon atoms. Preferably, hydrocarbyl is an alkyl group. The aryl portions may contain 6 to 14 carbon atoms.

As noted hereinabove, the boron compounds used include boric acid, boric oxide and an alkyl borate, preferably boric acid. The alkyl borates include the mono-, di- and trialkyl borates, such as the mono-, di and triethyl borates.

Ammonium hydroxide, often in the presence of water, is the preferred ammonium compound. An excess of ammonium hydroxide in water can be advantageously used. The reaction between ammonia or ammonium compound can be carried out at between about 60° C. and about 200° C., preferably from about 70° C. to about 130° C. The temperature chosen will depend, for the most part, on the particular reactants, or whether or not a solvent is used or whether a catalyst is used to accelerate the opening of the epoxide bond. Greater than atmospheric pressures are generally used to contain the reactants, especially when elevated reaction temperatures are chosen. Reaction pressures of 100 psig up to 1000 psig and more are often beneficial. In carrying out this reaction, it is preferable that up to a stoichiometric amount of ammonia or ammonium compound be used. Typically, from about 0.1 mole to about 1.0 mole of ammonia hydroxide is used for each mole of epoxide. More than a stiochiometric amount can be advantageous and does not seem to detract from the value of this invention. Solvents may also be used where warranted. In general, any relatively unreactive hydrocarbon or oxygenated hydrocarbon solvent, such as benzene, toluene, xylene, 1,4-dioxane and the like can be used. Water can often be added to the ammonia or ammonium compound - epoxide reaction with beneficial results. Times for this reaction can be from 2 to 4 hours to up to 24 to 48 hours or more, depending primarily upon the temperature, pressures and solvents, or catalyst used.

The reaction between ammoniated epoxide and boron can be carried out at from about 80° C. to about 260° C., preferably from about 110° C. to about 180° C. The temperature chosen will depend for the most part on the particular reactants and on whether or not a solvent is used. In carrying out this reaction, it is preferable that quantities of reactants be chosen such that the molar ratio of epoxide to boron compound be from about 0.2 to 1 to about 4 to 1, preferably from about 0.5 to 1 to about 2 to 1. For example, in the reaction illustrated, in Example 1 the molar ratio is about 3 to 2. The epoxide can be partially borated, or reacted with an excess of the boronating species to form a composition containing from about 0.1% by weight of boron to as much as 10% boron or more.

While atmospheric pressure is generally preferred, either reaction can be advantageously run at from about 1 to about 5 atmospheres. Furthermore, where conditions warrant it, a solvent may be used. In general, any relatively non-polar, unreactive solvent can be used, including benzene, toluene, xylene and 1,4-dioxane. Other hydrocarbon and alcoholic solvents, the latter of which include propanol, butanol and the like, can be used. Mixtures of alcohol and hydrocarbon solvents can be used also.

The times for the reactions are not critical. Thus, any phase of the process can be carried out in from about 1 to about 20 hours.

Of particular significance, in accordance with the present invention, is the ability to improve the resistance to oxidation and corrosion and high temperature resistance properties of oleaginous materials such as lubricating media which may comprise liquid oils, in the form of either a mineral oil or a synthetic oil, or mixtures thereof, or in the form of a grease in which any of the aforementioned oils are employed as a vehicle. In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of thickening agents can be used in the grease of this invention. Included among the thickening agents are alkali and alkaline earth metal soaps of fatty acids and fatty materials having from 12 to about 30 carbon atoms per molecule. The metals are typified by sodium, lithium, calcium and barium. Fatty materials are illustrated by stearic acid, hydroxy-stearic acid, stearin, cottonseed oil acids, oleic acid, palmitic acid, myristic acid and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium, stearate-caprylate- acetate complexes (U.S. Pat. No. 2,999,065), calcium caprylate-acetate (U.S. Pat. No. 2,999,066), and calcium salts and soaps of low, intermediate and high-molecular weight acids and of nut oil acids.

Another group of thickening agents comprises substituted ureas, phthalocyamines, indanthrene, pigments such as perylimides, pyromellitdiimides, and ammeline.

The preferred thickening gelling agents employed in the grease compositions are essentially hydrophobic clays. Such thickening agents can be prepared from clays which are initially hydrophilic in character, but which have been converted into a hydrophobic condition by the introduction of long-chain hydrocarbon radicals into the surface of the clay particles; prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention.

In instances where synthetic oils are desired for any purpose herein, in preference to mineral oils, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

It is to be understood, however, that the lubricant compositions contemplated herein can also contain other materials. For example, corrosion inhibitors, extreme pressure agents, viscosity index improvers, coantioxidants, antiwear agents and the like can be used, including but not limited to phenates, sulfonates, succinimides, ashless or zinc diaryl or dialkyl dithiophosphates, sulfurized olefins, chlorinated hydrocarbons, overbased calcium and/or magnesium compositions, hindered phenols, amine antioxidants, and the like.

Mineral oil heat exchange fluids particularly contemplated in accordance with the present invention have the following characteristics: high thermal stability, high initial boiling point, low viscosity, high heat-carrying ability and low corrosion tendency.

Further, the transmission fluids of consequence to the present invention are blends of highly refined petroleum base oils combined with VI improvers, detergents, defoamants and special additives to provide controlled-friction or lubricity characteristics. Varied transmission design concepts have led to the need for fluids with markedly different frictional characteristics, so that a single fluid cannot satisfy all requirements. The fluids intended for use in passenger car and light-duty truck automatic transmissions are defined in the ASTM Research Report D-2; RR 1005 on "Automatic Transmission Fluid/Power Transmission Fluid Property and Performance Definitions." Specifications for low-temperature and aircraft fluids are defined in U.S. Government Specification MIL-H-5606A.

In addition, the oxidation and corrosion resistance, especially at elevated temperatures, of functional fluids such as hydraulic fluids can be improved by the adducts of the present invention.

The fuels that may be used for the purposes of this invention include (1) liquid hydrocarbon fuel, such as diesel oil, fuel oil and gasoline, (2) alcohol fuels such as methanol and ethanol and (3) mixtures thereof.

In general, the reaction products of the present invention may be employed in the lubricant any amount which is effectie for imparting the desired degree of friction reduction or antiwear activity or antioxidant activity, high temperature stability or antirust activity.

In many applications, however, the product is effectively employed in amounts from about 0.01% to about 10% by weight, and preferably from about 0.5% to about 5% of the total weight of the composition. The additive is most effective in liquid fuels when used to the extent of from about 5 to about 250 lbs. of additive per 1000 bbls. of fuel.

The following Examples will present illustrations of the invention. They are illustrative only, and are not meant to limit the invention.

EXAMPLE 1

Approximately 180 g of 1,2-epoxyhexadecane obtained commercially, 75 g of heptane and 170 g of 28% ammonium hydroxide were charged to a reactor. The air was removed by nitrogen flushing and the reactor was sealed. The contents of the reactor were heated up to 77° C. with agitation and held for six hours. The crude product was cooled and water washed four times at about 75° C. with hot water. The crude product was then dried via rotary evaporation under reduced pressure.

EXAMPLE 2

Approximately 54 g of the product of Example 1 and 80 g of toluene were placed in a reactor equipped with heater, agitator, Dean-Stark tube and condenser and were warmed to about ~60° C. Approximately 8 g of boric acid were added and the reactor were heated to 155° C. until water evolution via azeotroptic distillatioon ceased. Approximately 5 ml water were collected. The solvent was removed by distillation under reduced pressure and the crude product was filtered through diatomaceous earth.

EXAMPLE 3

Approximately 180 g of 1,2-epoxyhexadecane, 75 g of heptane and 168 g of 28% ammonium hydroxide were reacted, as generally described in Example 1, for six hours at 91° C. The crude product was cooled and water washed five times using hot water. The crude product was then dried using rotary evaporation under reduced pressure.

EXAMPLE 4

Approximately 54 g of the product of Example 3 and 80 g of toluene were placed in a reactor equipped as described in Example 2 and heated to about 60° C. Approximately 8 g of boric acid were added and the reactor was heated to 155° C. until water evolution via azeotropic distillation ceased. The solvent was removed by distillation under reduced pressure and the crude product was filtered through diatomaceous earth.

EXAMPLE 5

Approximately 360 g of 1,2-epoxyhexadecane, 340 g of 28% ammonium hydroxide and 200 g of ethylene glycol dimethyl ether were charged to a reactor as generally described in Example 1. The air was displaced by nitrogen, the reactor was sealed, and the contents were agitated at about 95° C. for six hours. The solvent was removed by rotary evaporation under reduced pressure and after cooling 200 g of benzene were added. The crude product in benzene was water washed at about 65° C. The crude product was dried using rotary evaporation under reduced pressure and then filtered hot through diatomaceous earth.

EXAMPLE 6

Approximately 120 g of the product of Example 5 and 100 g of toluene were placed in a reactor equipped as described in Example 2 and heated to about 50° C. Approximately 30 g of boric acid were added and the reactor was heated to 170° C. until water evolution via azeotropic distillation ceased. The solvent was removed by distillation under reduced pressure and the crude product was filtered through diatomaceous earth.

EVALUATION OF THE COMPOUNDS

The compounds were evaluated in a Low Velocity Friction Apparatus (LVFA) in a fully formulated 5W-40 synthetic automotive engine oil containing an additive package including antioxidant, dispersant and detergent. The test compounds were used at concentrations by weight of the total weight of oil shown in Table 1.

DESCRIPTION

The Low Velocity Friction Apparatus (LVFA) is used to measure the coefficient of friction of test lubricants under various loads, temperatures, and sliding speeds. The LVFA consists of a flat SAE 1020 steel surface (diameter 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam motor arrangement.

PROCEDURE

The rubbing surfaces and 12–13 ml of test lubricants are placed on the LVFA. A 240 psi load is applied, and the sliding speed is maintained at 40 fpm at ambient temperature for a few minutes. A plot of coefficients of friction ($U_k$) vs. speed were taken at 240, 300, 400, and 500 psi. Freshly polished steel specimens are used for each run. The surface of the steel is parallel ground to 4 to 8 microinches. the results in Table 1 refer to percent reduction in friction compared to the unmodified oil. That is, the formulation mentioned above was tested without the compound of this invention and this became the basis for comparison. The results were obtained at 250° F. and 500 psi.

TABLE 1

Friction Test Results Using Low Velocity Friction Apparatus

| Example | Additive Conc. in Base Blend, Wt. % | % Reduction in Coefficient of Friction in LVFA at 5 Ft./Min. | 30 Ft./Min. |
|---|---|---|---|
| Base blend-fully formulated SAE 5W-40 synthetic automotive engine oil containing detergent/dispersant/inhibitor package) | — | 0 | 0 |
| Example 2 plus base blend | 1.0 | 44 | 40 |
| | 0.5 | 39 | 34 |
| Example 6 plus base blend | 0.25 | 15 | 18 |

The results demonstrate that the ammonia-treated long chain epoxide borates are effective friction reducers. A 40–44% reduction in the coefficients of friction was observed with the use of 1% of Example 2. The use of only ½% of the borate reduced the coefficient of friction by an unexpected 39–34%.

I claim:

1. A product of reaction made by (1) reacting an epoxide of the formula

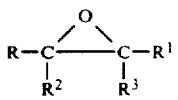

wherein R, $R^1$, $R^2$ and $R^3$ are hydrogen or $C_1$ to $C_{30}$ hydrocarbyl groups, at least one of which is a hydrocarbyl group, with a nitrogen compound of the formula $$(R^4)_aNX$$

wherein $R^4$ is hydrogen or a $C_1$ to $C_3$ hydrocarbyl group, X is hydrogen or hydroxyl, a being 2 when X is hydrogen or 4 when X is hydroxyl, and (2) reacting the material thus formed with a boron compound, reaction (1) being carried out at from about 60° C. to about 200° C. using from about 0.1 mole portion to about 1.0 mole portion of nitrogen compound per mole portion of epoxide, and reaction (2) being carried out at from about 80° C. to about 260° C. using sufficient boron compound to give a final product containing from about 0.1% by weight to about 10% by weight of boron.

2. The product of claim 1 wherein the R through $R^4$ are hydrocarbyl groups selected from alkyl, alkenyl, aryl, aralkyl, alkaryl, cycloalkyl and cycloalkenyl groups.

3. The product of claim 2 wherein the hydrocarbyl groups are alkyl groups.

4. The product of claim 1 wherein the boron compound is boric acid, boric oxide or an alkyl borate of the formula $$(R^5O)_xB(OH)_y$$

wherein $R^5$ is a $C_1$ to $C_6$ alkyl group, x is 1 to 3 and y is 0 to 2, the sum of x and y being 3.

5. The product of claim 4 wherein the boron compound is boric acid.

6. The product of claim 1 wherein the nitrogen compound is ammonium hydroxide.

7. the product of claim 1 wherein reaction (2) is carried out using from about 0.2 to about 4 moles of ammoniated epoxide per mole of boron compound.

8. The product of claim 1 wherein the epoxide is 1,2-epoxyhexadecane, the nitrogen compound is ammonium hydroxide and the boron compound is boric acid.

9. A lubricant composition comprising a major proportion of a lubricating oil or grease therefrom and a friction reducing amount of a product of reaction made by (1) reacting an epoxide of the formula

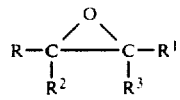

wherein R, $R^1$, $R^2$ and $R^3$ are hydrogen or $C_1$ to $C_{30}$ hydrocarbyl groups, at least one of which is a hydrocarbyl group, with a nitrogen compound of the formula $$(R^4)_aNX$$

wherein $R^4$ is hydrogen or a $C_1$ to $C_3$ hydrocarbyl group, X is hydrogen or hydroxyl, a being 2 when X is hydrogen or 4 when X is hydroxyl, and (2) reacting the material thus formed with a boron compound, reaction (2) being carried out at from about 60° C. to about 200° C. using from about 0.1 mole portion to about 1.0 mole portion of nitrogen compound per mole portion of epoxide, and reaction (2) being carried out at from about 80° C. to about 260° C. using sufficient boron compound to give a final product containing from about 0.1% by weight to about 10% by weight of boron.

10. The composition of claim 9 wherein the R through $R^4$ are hydrocarbyl groups selected from alkyl, alkenyl, aryl, aralkyl, alkaryl, cycloalkyl and cycloalkenyl groups.

11. The product of claim 9 wherein the hydrocarbyl groups are alkyl groups.

12. The product of claim 9 wherein the boron compound is boric acid, boric oxide or an alkyl borate of the formula $$(R^5O)_xB(OH)_y$$

wherein $R^5$ is a $C_1$ to $C_6$ alkyl group, x is 1 to 3 and y is 0 to 2, the sum of x and y being 3.

13. The composition of claim 12 wherein the boron compound is boric acid.

14. The composition of claim 9 wherein the nitrogen compound is ammonium hydroxide.

15. The composition of claim 9 wherein in reaction (1) the temperature is from about 60° C. to about 200° C. using from about 0.1 mole to about 1.0 mole of nitrogen compound per mole of epoxide.

16. The composition of claim 15 wherein in reaction (2) the temperature is from about 80° C. to about 260° C. using from about 0.2 to about 4 moles of ammoniated epoxide per mole of boron compound.

17. The composition of claim 9 wherein the epoxide is 1,2-epoxyhexadecane, the nitrogen compound is ammonium hydroxide and the boron compound is boric acid.

18. The composition of claim 9 wherein the lubricant is (1) a synthetic oil or a mixture of synthetic oils, (2) a mineral oil, (3) a mixture of (1) and (2) or (4) a grease from either of (1), (2) and (3).

19. The composition of claim 18 wherein the lubricant is the mineral oil of (1).

20. The composition of claim 18 wherein the lubricant is the synthetic oil of (2).

21. The composition of claim 18 wherein the lubricant is the mixed oils of (3).

22. The composition of claim 18 wherein the lubricant is the grease of (4).

23. The composition of claim 20 wherein the lubricant is a synthetic oil.

24. The composition of claim 20 wherein the lubricant is a mixture of synthetic oils.

25. A method of reducing fuel consumption in an internal combustion engine by lubricating same with compositions comprising a major amount of lubricant and a friction reducing amount of a product of reaction made by (1) reacting an epoxide of the formula

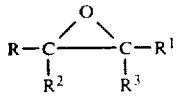

wherein R, $R^1$, $R^2$ and $R^3$ are hydrogen or $C_1$ to $C_{30}$ hydrocarbyl groups, at least one of which is a hydrocarbyl group, with a nitrogen compound of the formula $$(R^4)_aMX$$

wherein $R^4$ is hydrogen or a $C_1$ to $C_3$ hydrocarbyl group, x is hydrogen or a hydroxyl, a being 2 when X is hydrogen and 4 when X is hydroxyl, and (2) reacting the material thus formed with a boron compound reaction (1) being carried out at from about 60° C. to about 200° C. using from about 0.1 mole portion to about 1.0 mole portion of nitrogen compound per mole portion of epoxide, and reaction (2) being carried out at from about 80° C. to about 260° C. using sufficient boron compound to give a final product containing from about 0.1% by weight to about 10% by weight of boron.

* * * * *

UNITED STATES PATENT AND TRADEMARK OFFICE

CERTIFICATE OF CORRECTION

PATENT NO. : 4,492,642

DATED : January 8, 1985

INVENTOR(S) : Andrew G. Horodysky

It is certified that error appears in the above-identified patent and that said Letters Patent is hereby corrected as shown below:

Column 10, Line 11, the formula "$(R^4)_aMX$" should read --$(R^4)_aNX$--.

Signed and Sealed this

*Second* Day of *July 1985*

[SEAL]

*Attest:*

DONALD J. QUIGG

*Attesting Officer* *Acting Commissioner of Patents and Trademarks*